United States Patent [19]

Jones

[11] 4,066,208

[45] Jan. 3, 1978

[54] THEFT RESISTANT RECEPTACLE

[76] Inventor: Norman A. Jones, 4591 W. Streetsboro Road, Richfield, Ohio 44286

[21] Appl. No.: 771,768

[22] Filed: Feb. 24, 1977

[51] Int. Cl.[2] ..... A47G 29/12

[52] U.S. Cl. ..... 232/1 C; 232/22; 232/42

[58] Field of Search ..... 232/1 C, 22, 23, 42, 232/17

[56] References Cited

U.S. PATENT DOCUMENTS

| | | | |
|---|---|---|---|
| 448,500 | 3/1891 | Bussard | 232/22 |
| 468,103 | 2/1892 | Stillman | 232/42 X |
| 882,381 | 3/1908 | Haentze | 232/17 |
| 1,105,269 | 7/1914 | Good | 232/42 |
| 1,139,780 | 5/1915 | Levitt | 232/42 |
| 1,847,969 | 3/1932 | Marks | 232/42 |
| 1,959,045 | 5/1934 | Weiss | 232/42 |

*Primary Examiner*—Francis K. Zugel
*Attorney, Agent, or Firm*—John Harrow Leonard

[57] ABSTRACT

A newspaper holding receptacle is arranged to be disposed on the floor at or alongside the outside lower margin of a closed door of an apartment. The receptacle has a laterally disposed bracket so arranged that it can be attached to, and detached from, the lower end of the door readily while the door is open, but cannot be detached while the door is closed. The receptacle has a restricted entry opening through which a newspaper can be inserted easily while the receptacle is attached to the closed door, but cannot be withdrawn readily. The restriction of the entry passage is effected by an element which also functions for detachably connecting the bracket and receptacle in assembled relation.

4 Claims, 10 Drawing Figures

FIG. 5
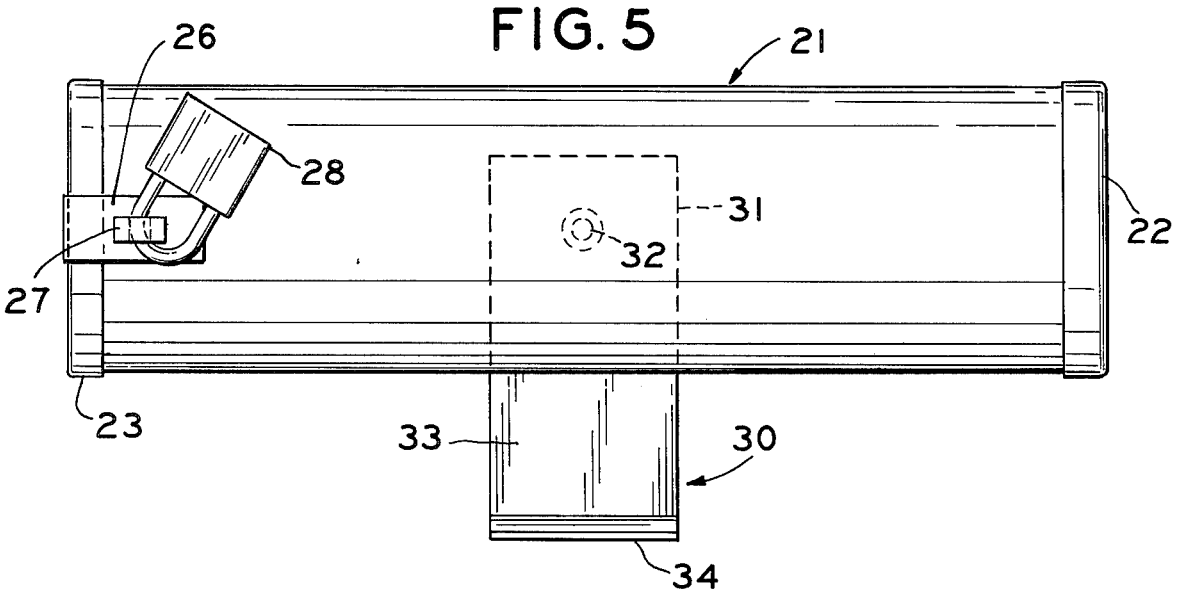
FIG. 6
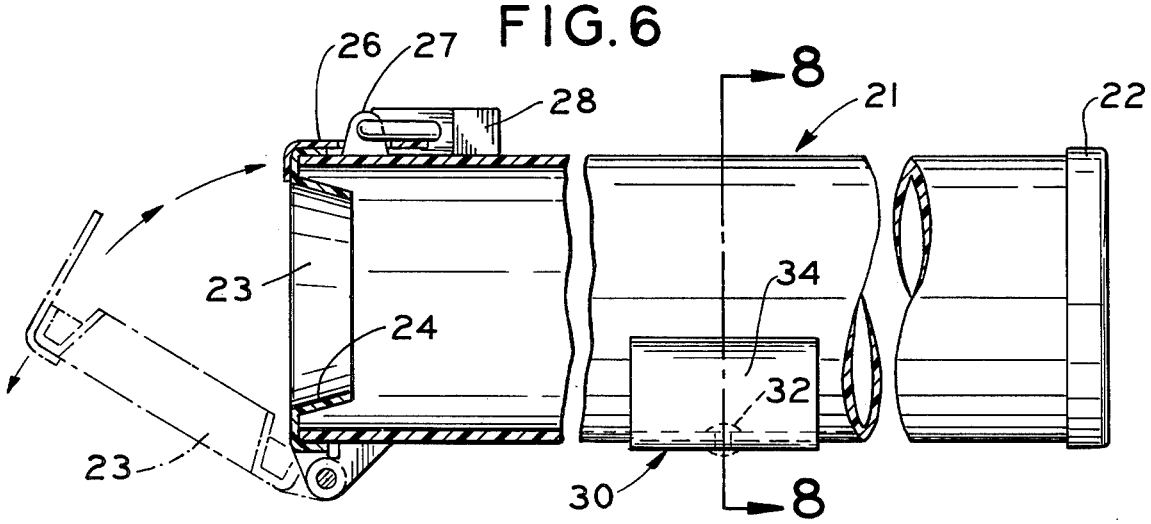
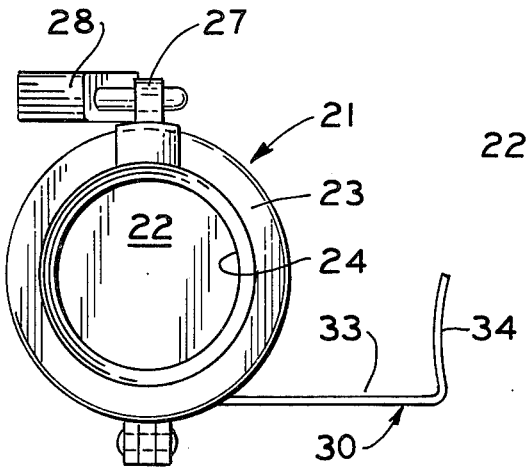
FIG. 7
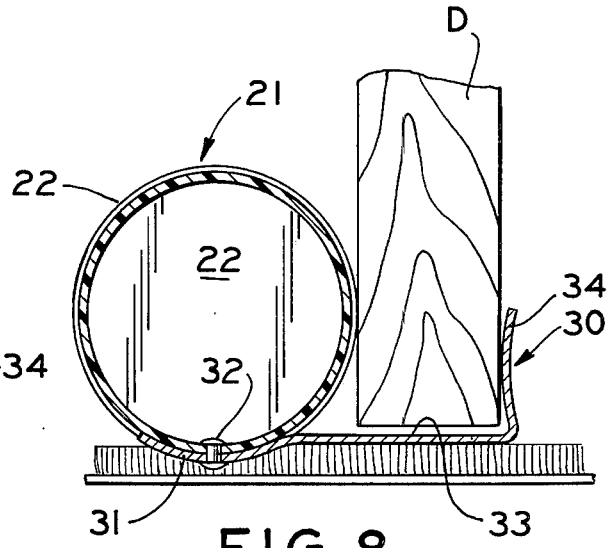
FIG. 8

THEFT RESISTANT RECEPTACLE

BACKGROUND OF INVENTION

1. Field of Invention

Theft resistant receptacle.

2. Prior Art

In apartment buildings, newspapers customarily are distributed by placing them on the floor in front of the doors of the apartments of the subscribers. The papers can be picked up readily and carried away by tenants or trespassers without a great likelihood of detection. To restrain such petty thefts, various holding devices have been provided. The prior devices for this purpose are permanently fastened to the apartment door or frame. Many are in the form of receptacles which are closed at one end and which have at the other end, a restricted entry passage through which the paper can be pushed while tightly rolled, but through which removal is difficult after the rolled paper, having been released, has expanded within the container. Generally, a receptacle door, held closed by a padlock, is provided at an end, or in the side, of the receptacle, so that the paper can be easily removed by unlocking and opening the receptacle door.

SUMMARY

The present device is a newspaper receptacle or holder which is adapted to rest on the floor closely adjacent a closed door of an apartment. The receptacle has a bracket of which one portion extends from the receptacle and beneath the lower edge of the closed door to the inside of the closed door. At the inside or inboard end of this portion, the bracket has an upturned retaining portion which engages the inner lower margin of the closed door and anchors the receptacle to the closed door, at or adjacent the outer face of the closed door, and thus prevents its removal. The entry passage of the receptacle is restricted so as to afford ready insertion of a tightly rolled newspaper, and to render difficult the removal of the newspaper through the entry passage. One end of the receptacle can be unblocked for affording free access to the interior of the receptacle for removal of the newspaper.

The receptacle is readily detachable from an open door simply by holding the receptacle at the outer lower margin of the door with the one portion of the bracket beneath the lower edge of the door and the upturned retaining portion against or adjacent the inner face of the lower margin of the door, and, while so held, sliding the receptacle and its bracket along the lower margin of the door away from the free upright edge of the door toward the hinged edge. The receptacle and bracket can be removed from the open door by reversal of this procedure, but cannot be removed from the door while the door is closed. A specialized type of bracket and connecting means for connecting the bracket to the receptacle, which can be assembled readily and which can also act to provide a restricted entry passage into the receptacle is provided.

Various specific objects and advantages of the invention will become apparent from the description wherein reference is made to the drawings.

BRIEF DESCRIPTION OF THE DRAWINGS

FIG. 5 is a top plan view of a modified form of the holder;

FIG. 6 is a front elevation of the holder illustrated in FIG. 5, part thereof being shown in section;

FIG. 7 is a left end elevation of the holder illustrated in FIGS. 5 and 6;

FIG. 8 is a cross sectional view of the holder illustrated in FIGS. 5 and 6, and is taken on the line 8—8 of FIG. 6;

Figure 1:
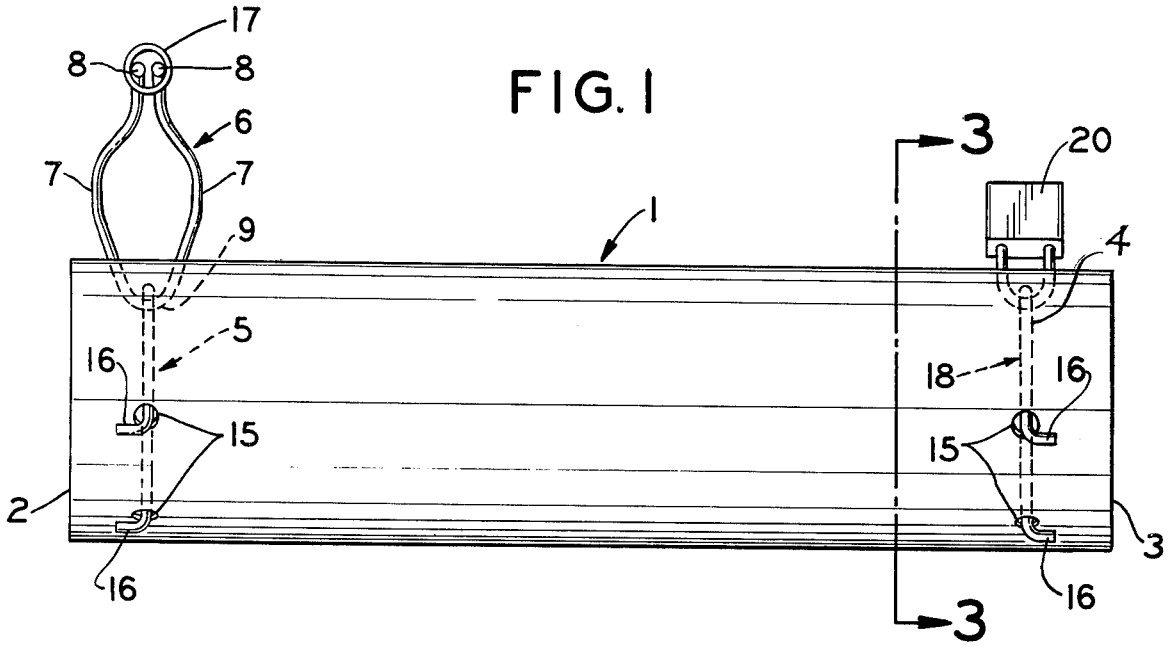
FIG. 1 is a top plan view of a theft restraining holder embodying the principles of the present invention.
Figure 2:
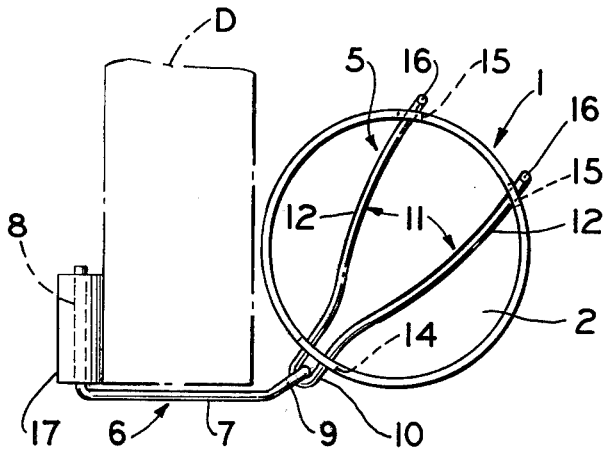
FIG. 2 is a left end elevation of the holder illustrated in FIG. 1.
Figure 3:
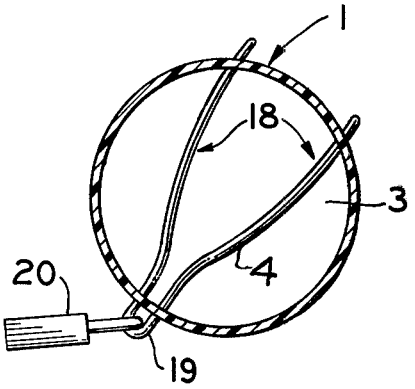
FIG. 3 is a cross sectional view of the holder, taken on the line 3—3 of FIG. 1.

Referring first to FIGS. 1 through 4, the holder is shown, for purposes of illustration, as comprising a receptacle 1, preferably in the form of a plastic or metal tube. The receptacle 1 has an entry passage 2 at one end. Its opposite end 3 is b1ocked by a suitable closure element 4, to prevent withdrawal of a newspaper therethrough from the interior of the tube while the element 4 is in place.

The entry passage 2 is restricted by an element 5. Each of the elements 4 and 5 can be withdrawn to afford access to the interior of the receptacle under certain circumstances, as later described herein.

A bracket 6 is attached to the receptacle 1. It comprises an arm or portion 7 arranged so that, when the receptacle 1 is lying on the floor adjacent to and alongside the outer lower margin of a closed door D, indicated by the dot and dash lines in FIG. 2, the portion 7 extends laterally from the receptacle, and lies beneath the bottom edge of the door D. The portion 7 extends to or slightly beyond the inside face of the door. At its inner end, the portion 7 has a retaining portion 8 which is bent upwardly at an abrupt angle to the portion 7, so that, while the door is closed, the portion 8 will engage the inner face of the door and prevent withdrawal of the bracket outwardly from the door. At its outer or opposite end, the portion 7 has a loop 9 which extends through a suitable eyelet 10 carried by the receptacle at its exterior. The eyelet 10 and bracket parts are arranged so that the receptacle can lie against, or closely adjacent to, the outer lower margin of the door D while also resting on the floor alongside and adjacent thereto, while the retaining portion 8 of the bracket 6 engages the inside lower margin of the door D, thus preventing removal of the receptacle from the door while the door is closed.

The holder may be attached readily to the door D simply by opening the door, and moving the receptacle 1 and bracket 6 together in embracing relation to the lower inner and outer margins and bottom edge of the door D, with the receptacle at the outside, and then sliding them along the door away from the free upright edge of the door with the receptacle so disposed at the outer face of the door near the lower margin, the retaining portion 8 disposed at the inner face of the door, and with the portion 7 disposed beneath the lower edge of the door.

As mentioned, it is desirable that the entry passage 2 of the receptacle be restricted so as to permit ready insertion of a newspaper therethrough while making it difficult for removal of the newspaper therefrom. For this purpose, a combined bracket attaching and passage restricting element 11 may be provided. In the form illustrated, the element 11 serves as an attachment for the bracket and also provides restriction of the entry passage. Also, it permits ready attachment and detachment of the bracket from the receptacle for assembly and disassembly. The element 11 comprises a length of relatively rigid wire, or rod, bent between its ends to provide the eyelet 10, above mentioned, and two legs 12 extending therefrom in divergent relation to each other. The peripheral wall of the receptacle 1 is provided with an elongated cicumferential slot 14 through which the eyelet portion 10 of the element 11 may be inserted and moved from the inside of the receptacle to a position in which it protrudes from the exterior of the wall a sufficient distance to receive the bracket 6. The receptacle wall is also provided with two holes 15, spaced circumferentially of the receptacle from each other and from the slot 14 and through which the legs 12 extend, respectively. The legs 12 are loosely received in the holes 15 and are of sufficient length to extend entirely through the wall of the receptacle and extend to the outside thereof while the eyelet 12 is in position outside of the receptacle. The outer end of the legs 12 have anchor portions 16, respectively, which are bent at an angle to the length of the legs 12. The eyelet 10, legs 12, and anchor portions 16 are proportioned relative to each other and to the receptacle 1 so that the element 11 can be installed readily by inserting the anchor portions 16 and legs 12 through the holes 15 while the element 11 is tilted relative to the receptacle 1 so that the eyelet 10 is disposed in endwise spaced relation to the adjacent end of the receptacle. The legs 12 are passed sufficiently far through the holes 15 so that the element 11 can be swung about the connection of the legs with the holes a distance to dispose the eyelet 10 within the receptacle 1 and in alignment radially with the slot 14. Next, the loop 9 of the bracket 6, is engaged with the eyelet 10. The size of the bracket 6 and the size of the eyelet 10 are related to each other so as to prevent the eyelet from being pulled back through the slot 14 into the interior of the receptacle while the loop 9 is in the eyelet 10. Due to this connection and the anchor portions 16 of the legs, the element 11 cannot be removed while the bracket 6 is connected thereto.

Figure 4:
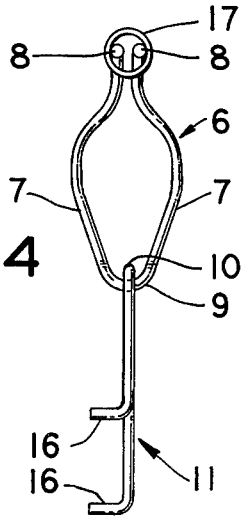
FIG. 4 is a top plan view of the bracket for the holder.

The bracket 6 preferably is in the form of a single length of stiff rod or wire, bent into a loop, as best illustrated in FIG. 4, and the retaining portion 8 of the bracket is comprised of the two free end portions of the loop. Thus the bracket 6 with the free end portions spaced apart from each other, can be threaded one end foremost through the eyelet 10 to position the loop 9 in the eyelet 10, as illustrated in FIG. 4. The free end portions then are brought together laterally, and a flexible tube 17 of suitable plastic material is slid thereover and both holds them in place to provide the retaining portion of the bracket 6 and prevents their marring of the door by the free ends during installation of the bracket 6 thereon.

The other end of the receptacle 1, indicated at 3, may be closed by a conventional cap, or by the closure 4, which may be essentially the same as the element 11, as indicated at 18, of which the eyelet element 19, corresponding to the eyelet 10, receives the hasp of a padlock 20. This structure has the advantage that all of the parts can be manufactured readily and packaged in unassembled condition for ready assembly, without tools, by the purchaser.

It is apparent that with the holder lying on the floor in installed position on the lower margin and bottom of a door, anyone attempting to remove the paper will be presented with considerable difficulty which ordinarily is enough to deter a potential sneak-thief from surreptitiously absconding with the paper.

Referring next to FIGS. 5 through 8, a modified form of the invention is illustrated in which a receptacle 21 is closed at one end by a cap 22 and at the entry end by a hinged cover 23. The hinged cover has a central passage 24 of which the peripheral wall is frusto-conical and disposed with its smaller end inwardly. The cover carries a hinged latching element 26 which can be swung into a position in which it receives an eyelet 27 on the receptacle 21 for holding the cover closed. A suitable padlock hasp 28 is passed through the eyelet 27 for holding the hinged cover 23 in closed position. In this form, the bracket, indicated at 30, may comprise a strap of metal or plastic having a portion 31 fastened to the bottom of the container in any suitable manner, for example by a rivet 32 or by cement. The bracket 30 has an intermediate portion 33 adapted to lie beneath the lower edge of the door when the receptacle is against or closely adjacent the outer face of the lower margin of the door. At its inboard end, the portion 33 has an upturned retaining portion 34 which, in the installed position of the receptacle, engages, or is closely adjacent to, the lower inner margin of the door. The device otherwise functions in a like manner to that illustrated in FIGS. 1 through 4.

Figure 9:
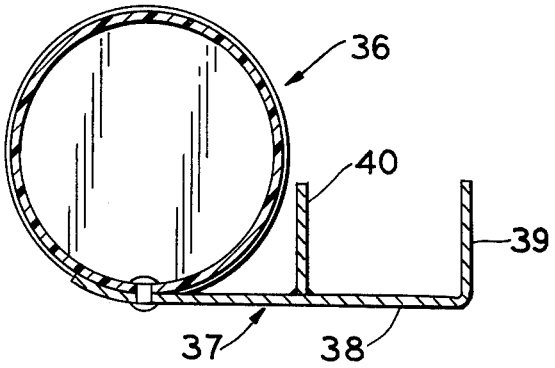
FIG. 9 is a view similar to FIG. 8 and illustrates another modification of the invention.

Referring to FIG. 9, this modification includes a receptacle 36, corresponding to the receptacle 21. A bracket, indicated at 37, is similar to that described in connection with FIGS. 5 and 8. It has an intermediate portion 38 adapted to lie beneath the door and an inboard upright retaining portion 39 adapted to engage the lower inside margin of the door. In addition, as distinguished from the brackets heretofore described, it has a supplemental upright bracket portion 40 spaced from the retaining portion 39, and engages or lies close to the outer lower margin of the door. The bracket 37 thus functions in general in the same manner as the brackets heretofore described.

Figure 10:
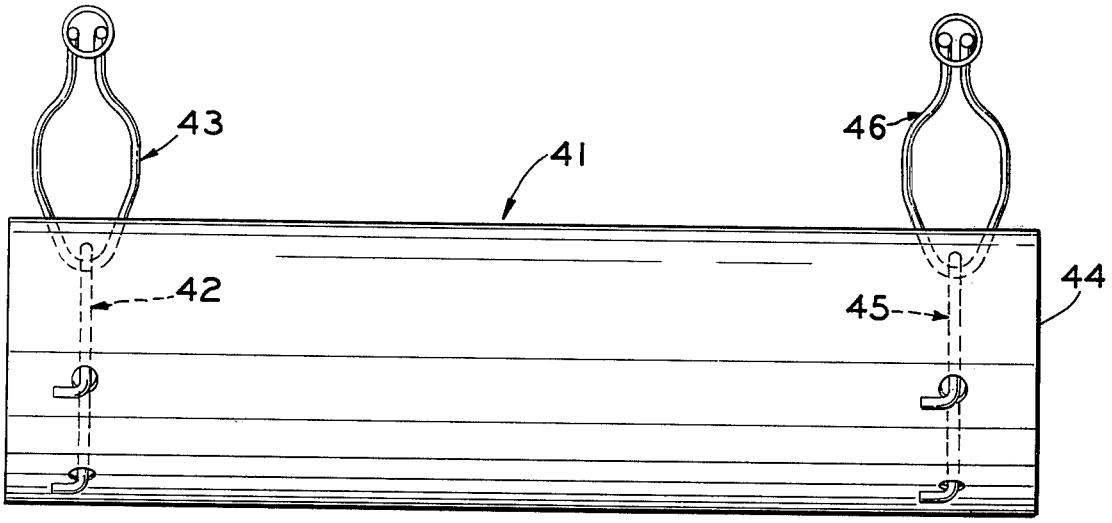
FIG. 10 is a view similar to FIG. 1 illustrating yet another modification of the invention.

Referring to FIG. 10, another modified holder is shown. It employs a receptacle 41 similar to the receptacle 1. The receptacle 41 is provided at its entry end with a combined entry restricting and bracket connecting element 42, corresponding to the bracket 6. At its opposite end, indicated at 44, the receptacle is provided with another element 45, corresponding to the element 42, and bracket 46, corresponding to the bracket 43. Thus the end 44 is held closed in the same manner as in FIG. 1, except that the element 45 is prevented from removal by a bracket 46, instead of by a padlock. This provides a very firm support, with a retaining bracket for the receptacle at each of its ends. Either one of the elements 42 and 45 may be readily removed, by disengaging the holder from the door and removing one or the other of the brackets 43 or 46, thus releasing its associated element 42 or 45 for withdrawal from restricting or closed position with respect to the receptacle.

Having thus described my invention, I claim:

1. A detachable holder for a newspaper, comprising: an elongated newspaper holding receptacle having a peripheral wall, the interior of the receptacle being inaccessible through its peripheral wall, and said receptacle having at an end a restricted entry passage through which a rolled newspaper can be inserted readily and removed only with difficulty, said receptacle being and adapted to be disposed horizontally, on a floor, at or near the outer face of the lower margin of a door and to extend, endwise of the receptacle, alongside said face;

bracket means carried by the receptacle near the ends of the receptacle, and having a first portion swingably connected to the receptacle for swinging upwardly and downwardly about a horizontal axis, to and past a horizontal plane through said axis, when the receptacle is so disposed horizontally, and positioned to extend generally horizontally laterally of the peripheral wall of the receptacle from the outside of the door, beneath the lower edge of the door, with an inner end disposed at the inside of the door, and having at said inner end a retaining portion disposed at an angle to said first portion, and said portions being positioned so that, while said first portion is beneath the lower edge of the door and said receptacle is disposed with said side wall closely alongside said outer face of the door, said second portion can engage the inner face of the door with slight clearance for constraining the bracket from removal outwardly of the door from beneath said lower edge of the door and the receptacle from movement outwardly from the door, while the door is closed, said bracket means comprising two separate brackets, one near each end of the receptacle, and each bracket including an eyelet secured to the receptacle and exposed externally of the peripheral wall thereof; and said first portion of each bracket having a portion spaced from its said retaining portion and loosely swivelly engaged in said eyelet for swinging upwardly and downwardly relative to the eyelet and receptacle.

2. A detachable holder according to claim 1 wherein each bracket includes a bracket connecting element which is carried by the receptacle and normally is detachable for removal therefrom;

said first portion of each bracket is detachably connected to its associated connecting element and is connected thereby to the receptacle, and, in turn, constrains its associated connecting element from detachment from the receptacle while said first portion of each bracket is connected to the associated connecting element, and said retaining portion of each bracket constrains the first portion of the bracket from disconnecting from the associated connecting element while said retaining portion is positioned at the inside of the door.

3. A detachable holder according to claim 2 wherein said receptacle has a peripheral side wall;

each connecting element has an eyelet and a leg portion;

said wall, at each connecting element, has a slot therethrough generally opposite from the slot;

said eyelet is movable inwardly from the outside of said wall to the inside to disengage it from said slot;

said leg portion is movable outwardly through the passage means by movement of the eyelet to the inside of the receptacle clear of the slot;

said leg portion fits the passage means loosely so as to enable said connecting element to be rocked endwise of the receptacle to a position such that the eyelet can be pulled away from alignment with the slot when clear thereof inwardly of the receptacle so as to enable the leg portion to be pulled inwardly of the receptacle and disengaged from the passage means, thereby to detach said connecting element from the receptacle.

4. A detachable holder according to claim 3 wherein the one of the connecting elements near the open end of the receptacle provides a restricted entry passage through which a rolled newspaper can be inserted readily and removed only with difficulty.

* * * * *

UNITED STATES PATENT AND TRADEMARK OFFICE

CERTIFICATE OF CORRECTION

PATENT NO. : 4,066,208

DATED : January 3, 1978

INVENTOR(S) : Norman A. Jones

It is certified that error appears in the above-identified patent and that said Letters Patent are hereby corrected as shown below:

Col. 1, line 46, for "detachable from" read --attachable to--.

Col. 6, line 19, (Claim 3, line 6,) after "therethrough" read --and passage means therethrough--.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*